US006371168B1

(12) United States Patent
Kozlowski

(10) Patent No.: US 6,371,168 B1
(45) Date of Patent: Apr. 16, 2002

(54) REED CLEANING APPARATUS AND METHOD

(75) Inventor: Derek S. Kozlowski, Greer, SC (US)

(73) Assignee: Milliken & Company, Spartanburg, SC (US)

( * ) Notice: Subject to any disclaimer, the term of this patent is extended or adjusted under 35 U.S.C. 154(b) by 0 days.

(21) Appl. No.: 09/415,990

(22) Filed: Oct. 12, 1999

(51) Int. Cl.[7] ..... D03J 1/00
(52) U.S. Cl. ..... 139/1 C; 15/387; 15/246
(58) Field of Search ..... 139/1 C; 15/387, 15/246, 312.1

(56) References Cited

U.S. PATENT DOCUMENTS

| | | | | |
|---|---|---|---|---|
| 4,527,596 A | * | 7/1985 | Kagi | 139/1 C |
| 4,964,441 A | | 10/1990 | Long et al. | 139/1 C |
| 4,969,488 A | | 11/1990 | Long et al. | 139/1 C |
| 5,005,606 A | | 4/1991 | Carroll | 139/1 C |
| 5,076,303 A | | 12/1991 | McBrady et al. | 134/21 |
| 5,086,810 A | | 2/1992 | Carroll | 139/1 C |
| 5,163,201 A | | 11/1992 | Raasch et al. | 15/304 |
| 5,197,520 A | | 3/1993 | Reimertz | 139/1 C |
| 5,237,717 A | | 8/1993 | Watson | 15/302 |
| 5,244,504 A | | 9/1993 | Watson | 134/21 |
| 5,279,334 A | * | 1/1994 | Takegawa | 139/1 C |

FOREIGN PATENT DOCUMENTS

| | | |
|---|---|---|
| JP | 61083357 | * 12/1986 |

* cited by examiner

*Primary Examiner*—Andy Falik
(74) *Attorney, Agent, or Firm*—Terry T. Moyer; Charlotte C. Wilson

(57) ABSTRACT

Method and apparatus to employ rotating brushes to remove the lint, size, trimer, dirt, etc. from the reed of a weaving machine in an efficient manner without removing the reed from the weaving machine, without disengaging the warp yarn sheet, and without significantly reducing the tension on the warp yarn sheet. The apparatus is particularly effective on air jet weaving machines, on which the apparatus simultaneously cleans the reed and the auxiliary air nozzles. The apparatus has a pair of reed guides and a clamping air cylinder that engage the reed; a plurality of wheels that deflect the warp yarn sheet in a downward direction, exposing the reed and auxiliary air nozzles for cleaning; and a drive motor and a winder drum mechanism that allow the cleaning apparatus to be readily moved across the loom. The apparatus has the desirable features of being efficient, portable, and economical, as one apparatus can be used to clean many weaving machines.

20 Claims, 4 Drawing Sheets

REED CLEANING APPARATUS AND METHOD

BACKGROUND OF THE INVENTION

This invention relates generally to the cleaning of reeds on textile weaving machines. In particular, this invention relates to the simultaneous cleaning of the reeds and auxiliary air nozzles found on air jet weaving machines (or looms) without removing the reed from the loom, without disengaging the warp yarn therefrom, and without reducing the warp yarn tension.

The reed, in typical construction, has a C-shaped channel or tunnel that is formed by the shape of the individual dents that comprise the reed. Fill yarn is propelled through this C-shaped tunnel across the loom during operation of the loom. Because of the shape of the tunnel, size, lint, trimer, dirt, loom oils, and the like tend to accumulate in this area. Fiber residue may also be a part of this accumulation, particularly when weaving with spun fibers. When accumulations in the reed tunnel occur, the fill yarn is more easily knocked out of the tunnel, causing filling stops and decreased production efficiency. It is known that periodic cleaning of the tunnel, therefore, results in decreased machine stops and improved productivity.

In the case of air jet weaving machines, the fill yarns are propelled through the tunnel and across the loom by air from the main air nozzle and are further propelled by a series of auxiliary air nozzles located directly beneath the yarn sheet. The fill yarn is propelled by a sequenced progression of pressurized air bursts from this series of auxiliary air nozzles spaced across the width of the loom (and along the path of the fill yarn). Each air nozzle has at least one small aperture through which pressurized air flows. These small apertures are easily clogged by size, trimer, and fiber particles as might accumulate in the reed tunnel, thus causing the nozzles to function less efficiently. Because of the size and position of these auxiliary air nozzles in the loom, adequate cleaning of these nozzles has been difficult to achieve and has not, heretofore, been successfully addressed by other cleaning machines.

It is necessary for efficient operation of a loom to clean the lint, size, trimer, and the like from on and between the dents of the reed. In the past, cleaning has been accomplished in a number of ways, none of which is completely satisfactory. The most straightforward way to clean the reed is to disengage the warp yarn sheet and remove the reed from the loom for cleaning. This is very time-consuming and inefficient. Alternative methods, including systems for leaving the reed in the loom and blowing or ultrasonically treating the reed in place, have been tried but do not perform the necessary cleaning as quickly or thoroughly as desired. Other methods require the tension on the yarn sheet to be significantly reduced, but it has been found that this makes the individual yarns more likely to break during the cleaning of the reed. In addition, cleaning methods that require the reed to be moved to a remote position or that require the tension of the yarn sheet to be significantly reduced typically result in a defect in the finished woven product. The present invention avoids these shortcomings.

Furthermore, existing reed cleaning machines do not address a problem specific to air jet weaving machines, that of cleaning the auxiliary air nozzles described above. Accordingly, the present invention not only solves the problem of cleaning of the reed in a highly efficient manner, but also allows for the simultaneous cleaning of the auxiliary air nozzles, a need largely ignored by the prior art.

SUMMARY OF THE INVENTION

The present invention is an apparatus that cleans the tunnel of the reed and, at the same time, is capable of cleaning the auxiliary air nozzles that are located beneath the yarn sheet in air jet weaving machines. The apparatus is held in alignment on the reed by the clamping action of a clamping air cylinder, whose directional movement against the face of the reed secures the apparatus to the reed. The apparatus has rotating brushes that simultaneously clean the reed (and, where applicable, auxiliary air nozzles) as the apparatus is pulled across the weaving machine by an on-board drive mechanism that includes a winder drum around which a drive cable is wound. In a preferred embodiment, the apparatus is powered by pneumatic motors.

It is an object of this invention to provide an apparatus and method to efficiently clean the reed of a textile weaving machine without the need for removing the reed, disengaging the warp yarns therefrom, or significantly reducing the tension on the warp yarns.

It is a further object of this invention to provide an apparatus and method to efficiently clean the auxiliary air nozzles of an air jet weaving machine, simultaneously with the cleaning of the reed, without the need for removing the reed, disengaging the warp yarns therefrom, or significantly reducing the tension on the warp yarns.

It is another object of this invention to provide an apparatus and method to clean the reed and the auxiliary air nozzles of an air jet weaving machine with an apparatus that can easily be attached to a machine and that is capable of carrying out such cleaning operations with minimal operator assistance.

It is yet another object of this invention to provide an apparatus with the features of stability and portability, such that it may move across the reed without becoming misaligned and may be moved from one weaving machine to another, as machine cleaning requirements dictate, quickly and without difficulty.

Other objects and advantages of the invention will become readily apparent from the following description of the invention, together with reference to the accompanying drawings, in which:

DETAILED DESCRIPTION

In the preferred form of the invention, the reed and auxiliary air nozzle cleaning apparatus is disclosed in conjunction with an air jet weaving machine with the warp yarns located in the weaving position (that is, the warp yarns are threaded through the reed). It is less desirable that the apparatus of the present invention be used to clean reeds off-loom, because cleaning of the auxiliary air nozzles, of which this invention is fully capable, would not be realized in that case.

It has been found that the cleaning apparatus of the present invention is also effective in cleaning the reeds of rapier and water jet looms, although those loom styles do not incorporate auxiliary air nozzles. No modifications to the cleaning apparatus are required to accommodate the cleaning of the reeds of rapier or water jet looms.

For purposes herein, however, the term "weaving machine" or "loom" shall refer to an air jet weaving machine, on which the benefits of the cleaning apparatus are most apparent. The term "front" shall refer to the operator side of the apparatus. The term "rear" shall refer to the machine side of the apparatus, the rear or machine side being that side of the apparatus that is away from the operator. In operation, the apparatus straddles the reed of the weaving machine, with the front side of the apparatus facing the operator and the rear side of the apparatus facing away from the operator.

The apparatus could be operated by electric or hydraulic motors, but pneumatic motors are preferred due to the proximity of the apparatus to an air source (most likely, the weaving machine itself. The appropriate air pressure is determined by the speed at which the apparatus is to move along the reed and the motor torque required to turn the brushes against a selected reed, as based upon various reed constructions. A suitable range of air pressures being supplied to the apparatus is 15 to 150 pounds per square inch (gauge), with a preferred range of 20 to 80 p.s.i.g.

Figure 1:
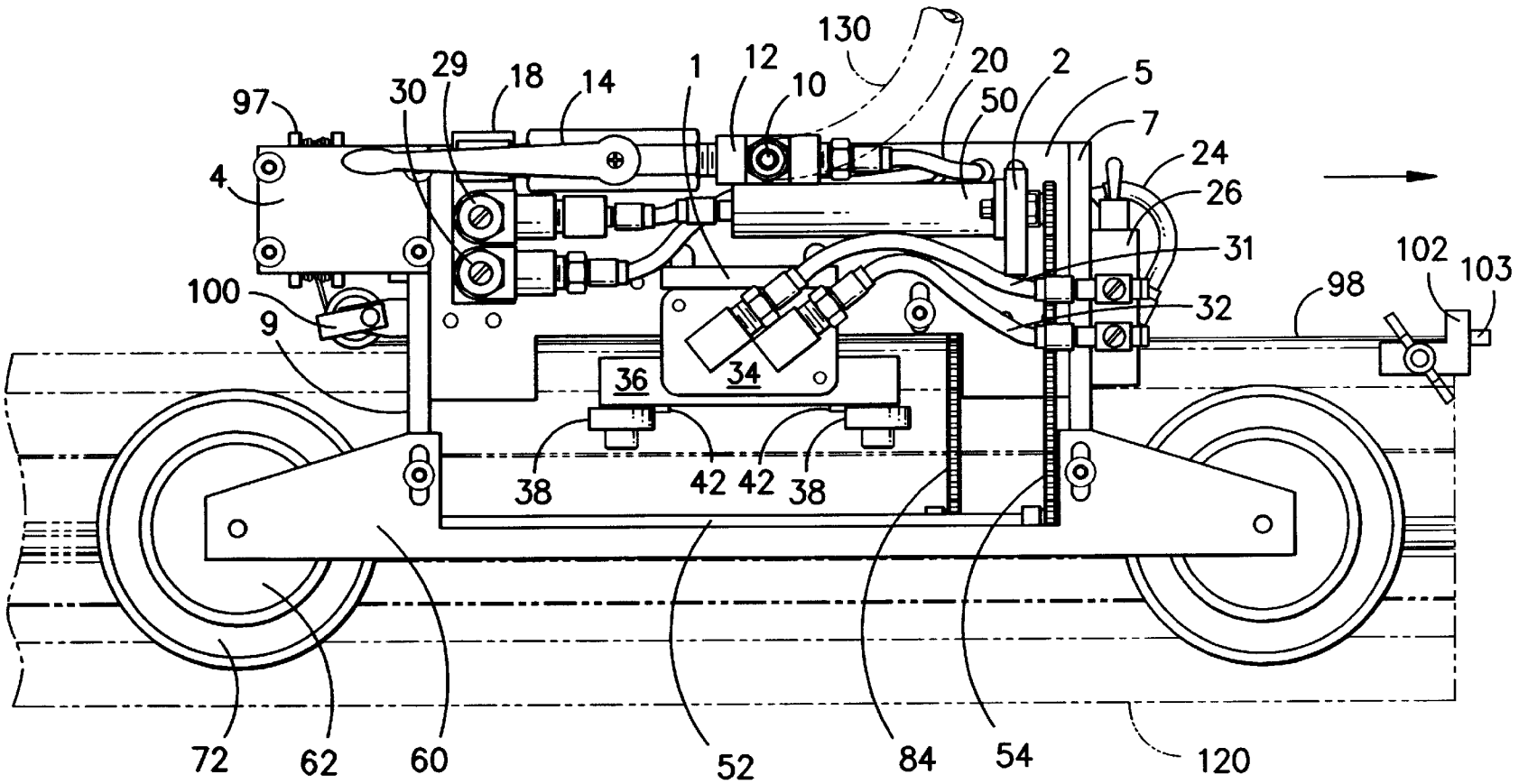
FIG. 1 is a schematic front elevation view of the reed and auxiliary air nozzle cleaning apparatus of the present invention.
Figure 2:
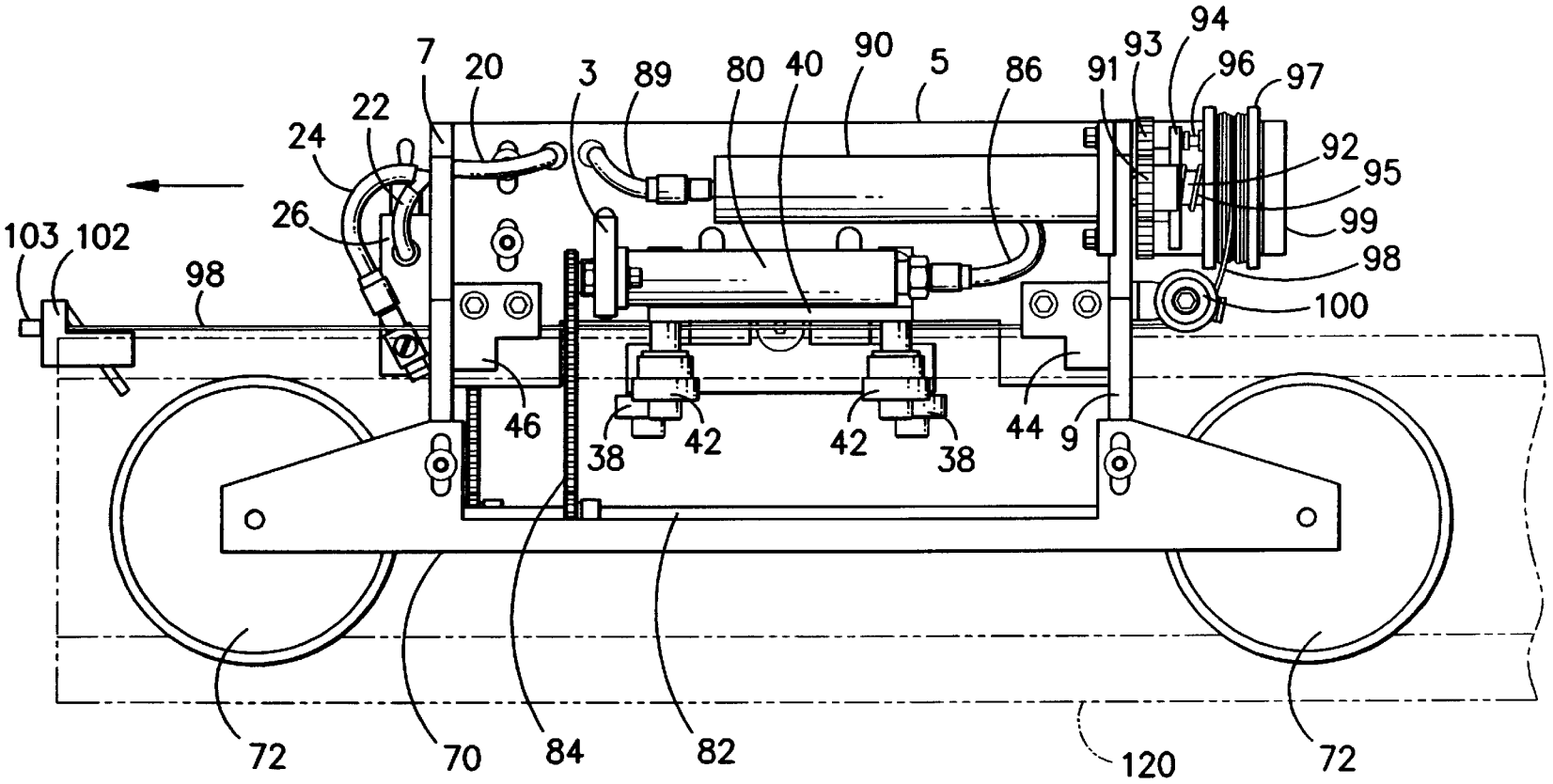
FIG. 2 is a schematic rear elevation view of the reed and auxiliary air nozzle cleaning apparatus of FIG. 1.
Figure 3:
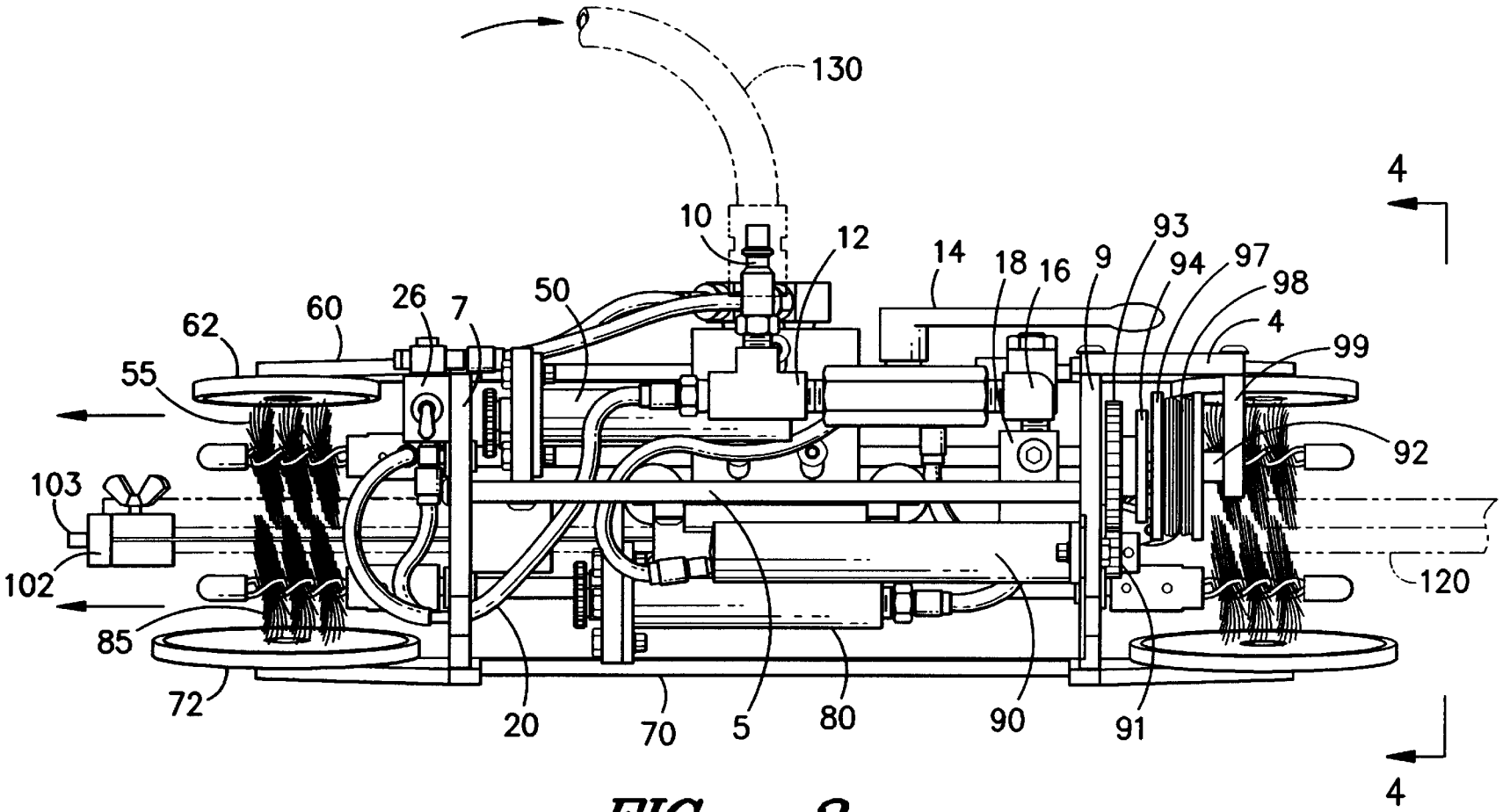
FIG. 3 is a schematic overhead, or plan, view of the reed and auxiliary air nozzle cleaning apparatus of the present invention, in which the brushes have been attached in their relative positions.

The cleaning apparatus of the present invention, as shown in FIG. 1, is constructed around a vertically oriented support partition 5 positioned in substantially perpendicular relation between two vertically oriented end plates 7, 9. The apparatus is powered by air from an external air supply (ideally, the loom itself). Air from the external air supply travels through a conventional air supply conduit (shown in phantom at 130 in FIGS. 1, 3, and 4) to a centrally located, "quick-disconnect"-type air nipple 10. From air nipple 10, air flows through T-shaped connector 12 that directs the air into two separate streams: a first stream (that flows through on/off lever 14 and elbow joint 16 into air manifold 18, as shown in FIG. 3) that is further divided into two streams through drive speed adjustment valve 29 and brush speed adjustment valve 30 (shown in FIG. 1); and a second stream (that flows through switch supply hose 20 and secondary supply hoses 22, 24 to three-way directional switch 26, as shown in FIG. 2) that supplies air for activating the clamping action of clamping air cylinder 34. Air from the second stream flows through directional switch 26 (FIG. 1) to clamping air cylinder 34 via hose assemblies 31, 32. When pressurized air is supplied to the apparatus, air flows through directional switch 26, which, when engaged, supplies air to clamping air cylinder 34. That is, the clamping action of clamping air cylinder 34 is activated by the flow of air through directional switch 26, and the flow of air into directional switch 26 is separate from the flow of air into on/off lever 14. Thus, the clamping action secures the apparatus to reed 120 before lever 14 is pushed to the "on" position to begin cleaning operations.

In FIG. 1, connecting plate 1 is attached to a center portion of support partition 5. Clamping air cylinder 34 is positioned directly below, and is attached to, connecting plate 1. Clamping air cylinder 34 moves toward the face, or front portion, of reed 120 in order to apply sufficient pressure, via clamping arm 36 and clamping wheels 38, to hold the cleaning apparatus in position against the face of reed 120. This directional movement is activated by air flow from directional switch 26. As mentioned above, clamping air cylinder 34 has hose assemblies 31, 32 that connect each of the portals of cylinder 34 with each of the portals of directional switch 26.

Clamping air cylinder 34 includes clamping arm 36, which is a horizontal member under which two clamping wheels 38 are positioned at either end. Clamping wheels 38 are in contact with the face of reed 120 directly above the tunnel portion of reed 120 and aid in maintaining the position of the apparatus on reed 120 as the apparatus moves across reed 120.

FIG. 2 shows a view of the apparatus from the rear (i.e., from the machine side, rather than the operator, or front, side). Attached to support partition 5 is clamping roller mount 40. Clamping roller mount 40 is mounted horizontally in a position parallel to the face of reed 120 and includes two rear stepped wheels 42 that are mounted to the underside of clamping roller mount 40. Clamping roller mount 40 operates in conjunction with clamping air cylinder 34 (specifically, with clamping arm 36 and clamping wheels 38) to secure the apparatus to reed 120; air flowing through clamping air cylinder 34 forces clamping arm 36 against the face of reed 120. Because the flow of air actuates a clamping action that continues during the operation of the apparatus, the apparatus remains in proper vertical alignment on reed 120 throughout the cleaning process. Without the cooperative relationship between clamping air cylinder 34 and clamping roller mount 40, the tension on warp yarn sheet 122 would cause the apparatus to rise off of reed 120 during operation, thereby negatively impacting the efficient cleaning of reed 120 and effectively negating the cleaning of auxiliary air nozzles 124.

Clamping wheels 38 (located on clamping air cylinder 34) and stepped wheels 42 (located on clamping roller mount 40) are free to rotate along the front and rear sides of reed 120, respectively, with reed 120 assuming a functional role as a track along which the apparatus traverses. In addition to aiding in the movement of the apparatus, stepped wheels 42 provide a further benefit to the apparatus by aligning themselves with the upper edge of reed 120 and providing an additional stabilizing force for the apparatus.

Turning again to FIG. 1, front brush motor 50 is attached to support partition 5 by means of connecting plate 2. Connecting plate 2 has an opening through which a screw is positioned, the position of the screw determining the tension on front drive chain 54. (Front drive chain 54 is shown on the right side of the apparatus in FIG. 1.) Front brush motor 50 is connected to front brush shaft 52 by front drive chain 54 and a pair of sprockets (not shown), where a sprocket is located on one end of front brush motor 50 and a corresponding sprocket is located on one end of front brush shaft 52. The preferred speed range for front brush motor 50 is 300 to 1100 revolutions per minute, with the setting based on the level of debris accumulation in reed 120 and the desired speed of the apparatus in traversing the loom.

Front brush shaft 52 is positioned through brush bearings (not shown), respectively positioned in both end plate 7 and end plate 9. Bearings hold front brush shaft 52 in position within the apparatus, while allowing front brush shaft 52 to rotate and thereby turn corresponding brushes 55. Front brush shaft 52 and front brushes 55 are shown in FIG. 3. Corresponding rear brush shaft 82 and rear brushes 85 are shown in FIGS. 2 and 3, respectively.

Figure 4:
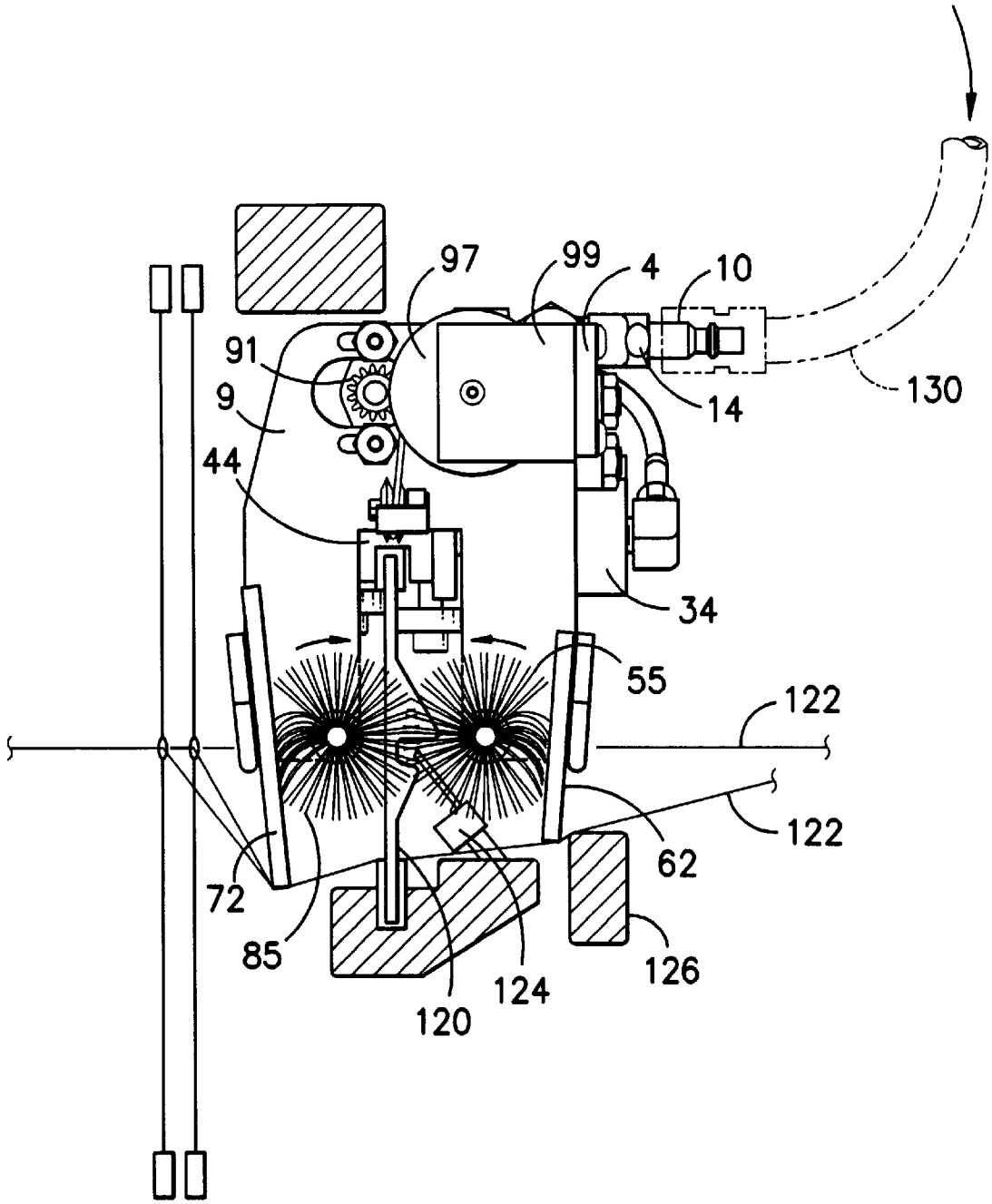
FIG. 4 is a schematic view of one end of the reed and auxiliary air nozzle cleaning apparatus of FIG. 3, as seen along line 4—4 of FIG. 3.

Brushes 55, 85 are attached to brush shafts 52, 82 in any conventional manner that will enable brushes 55, 85 to remain firmly attached to brush shafts 52, 82 and yet will enable brushes 55, 85 to rotate freely in order to clean. reed 120 and auxiliary air nozzles 124 (see FIG. 4). Brush guards positioned over the area where the brushes 55, 85 are connected to brush shafts 52, 82 protect brushes 55, 85 from incidental contact with reed 120 during operation.

Brushes 55, 85 can be made to rotate in a clockwise or counterclockwise direction, and should be set to rotate in opposite directions (i.e., counter-rotating). It is found to be especially effective to have front brush shaft 52 rotate in a counterclockwise direction while rear brush shaft 82 rotates in a clockwise direction. Because the bottom portion of the tunnel of reed 120 is generally more susceptible to accumulations of dirt, size, trimer, and the like, it is necessary to adjust the rotational motion of brushes 55, 85 to effect adequate penetration of the brush bristles into the tunnel. By setting brushes 55, 85 to counter-rotate, increased contact between brushes 55, 85 and reed 120 is achieved, and the motion of counter-rotation causes brushes 55, 85 to work in cooperation with one another, rather than in opposition to one another. FIG. 4 illustrates these brush settings and the spatial relationship of the apparatus within the loom.

Additional brush shafts having additional brushes could also be incorporated into the apparatus. For instance, a third brush shaft could be added, with that shaft being operably connected to front brush motor 50 and being positioned to clean certain portions of reed 120. A fourth brush shaft, being operably connected to rear brush motor 80, would include brushes positioned to clean other portions of reed 120, if necessary.

Each yarn deflector bar 60, 70 (FIGS. 1, 2) is positioned parallel to support partition 5 and is attached to end plate 7 and end plate 9. A rubber-coated wheel (shown at 62, 72) is attached to each end of each deflector bar 60, 70, outboard of respective end plates 7, 9. As depicted in FIG. 4, yarn deflector wheels 62, 72 push yarn sheet 122 downward in order to expose the reed tunnel and to allow the apparatus to effectively clean reed 120 and auxiliary air nozzles 124 without harm to yarn sheet 122. The rubber coating on yarn deflector wheels 62, 72 prevents the entanglement, snagging, or breaking of the yarn sheet 122 as the apparatus moves along reed 120 and across yarn sheet 122. Smaller yarn deflector wheels 62 are used on front yarn deflector bar 60, because of space constraints associated with sleigh bar 126 of the loom.

Once pushed downward by wheels 62, 72, yarn sheet 122 is held in a deflected orientation by the edge portions of yarn deflector bars 60, 70 which keep yarn sheet 122 from rising and thereby interfering with the operation of the apparatus. FIG. 1 shows that front yarn deflector bar 60 is positioned slightly below the level of front brush shaft 52 and also shows the comparative sizes of front yarn deflector wheels 62 and rear yarn deflector wheels 72. Rear yarn deflector bar 70 (associated with rear yarn deflector wheels 72) is shown in FIG. 2.

It is important to the operation of the apparatus that the tension of yarn sheet 122 not be reduced significantly. The tension of yarn sheet 122 prevents the individual yarns comprising yarn sheet 122 from being pushed out of lateral alignment by yarn deflector wheels 62, 72 and being broken or damaged. In the majority of weaving machines on which this apparatus is used effectively, no adjustments to yarn tension are required prior or subsequent to cleaning. It is anticipated, however, that on certain weaving machines having cammed harnesses, it may be necessary to slightly reduce the warp yarn tension in order to securely attach the apparatus to reed 120.

As shown in FIG. 2, rear brush motor 80 is located directly above the clamping roller mount 40 and is attached to support partitions by connecting plate 3. Rear brush motor 80 powers rear brush shaft 82 by a pair of sprockets (not shown) and rear drive chain 84. The operation of rear brush motor 80 is similar to that of front brush motor 50, previously described, with the same preferred speed range.

Like front brush motor 50, rear brush motor 80 is a pneumatic motor. Hose assembly 86 connects rear brush motor 80 with brush speed adjustment valve 30 (shown in FIG. 1) on the front of the apparatus. It is contemplated that alternative drive mechanisms could also be employed, such as belts, pulley systems, gears, and the like.

Pneumatic drive motor 90 is also shown in FIG. 2. Drive motor 90 is fixedly attached to end plate 9. Hose assembly 89 connects drive motor 90 with drive speed adjustment valve 29 (shown in FIG. 1) on the front of the apparatus. Drive speed adjustment valve 29 controls the rate at which the apparatus moves across the loom. The drive speed setting is based on levels of debris accumulation within reed 120, the style of reed 120, and the style of fabric being produced. A slower drive speed generally results in a more thorough cleaning of reed 120. The apparatus can be operated as slowly as desired to produce efficient cleaning and includes the capability of pausing the apparatus at any point along reed 120 in order to more thoroughly clean a given area. The maximum practical rate of speed utilized in the cleaning process has been found to be approximately six feet per minute (6 ft/min).

The drive mechanism, or motive means, of the apparatus includes drive motor 90 and a winder drum 97 around which a portion of a length of drive cable 98 is wound. Opposite the hose assembly end of drive motor 90 is drive motor gear 91. Drive motor gear 91 engages meshing gear 93 of a drive assembly. The drive assembly is located along drive assembly axle 92 (FIG. 3) and is comprised of combined meshing gear 93 and locking plate 94, spring 95, winder drum 97 having locking pin 96, a length of drive cable 98 partially wrapped around drum 97, and axle support plate 99. Drive assembly axle 92 is connected to axle support plate 99 (FIGS. 2, 3) which is perpendicular to support partition 5 (FIGS. 3, 4). Axle support plate 99 is connected to end plate 9 by means of connecting plate 4 (FIGS. 3, 4) that is parallel to support partition 5.

Meshing gear 93 and locking plate 94 are attached to one another. Meshing gear 93 is engaged by drive motor gear 91 of drive motor 90. Locking plate 94 to which meshing gear 93 is attached has a circular opening off-center from drive assembly axle 92, into which locking pin 96 is inserted. The relationship between locking plate 94 and locking pin 96 is characterized as that of a pin-and-groove construction, with locking plate 94 having a groove on the forward side of the aforementioned circular opening; locking pin 96 is initially inserted into the circular opening and is then rotated into a locked position in the groove.

Locking pin 96 is positioned on the outer rim portion of winder drum 97. Winder drum 97 has flanges on either side, which have knurled edges to facilitate handling by an operator. Around winder drum 97 is wound a portion of drive cable 98, the entire cable typically having a five- to fifteen-foot length, with the width of the loom being the primary consideration in determining the appropriate cable length. Drive cable 98 preferably is aircraft cable having a diameter of 3/32 inch to 1/8 inch. Spring 95 is located between locking plate 94 and winder drum 97 along drive assembly axle 92. Spring 95 holds winder drum 97 (and therefore locking pin 96) in a disengaged, or unlocked, position when the apparatus is not in use. Winder drum 97 provides a benefit in terms of safety: by requiring an operator to compress spring 95 and engage locking pin 96 prior to operation, accidental start-up, which might otherwise be caused by incidental contact, is prevented. In the unlocked position, an operator can pull a length of drive cable 98 from winder drum 97 and prepare the apparatus for operation.

Drive cable 98 leaves winder drum 97 in a vertical direction, and is turned into the horizontal direction needed for operation by guide pulley 100 positioned along the outer side of end plate 9 (see FIGS. 1, 2). Drive cable 98 then passes through end plate 9 and U-shaped reed guide 44 positioned directly along the inner side of end plate 9. Reed guide 44, which is mounted directly to support partition 5, is made of a low-friction material and provides vertical alignment of the apparatus on reed 120. Reed guide 46 is mounted on support partition 5 adjacent to end plate 7 and has the same physical and functional characteristics. The position of each reed guide 44, 46 along respective end plates 9, 7 is adjustable to ensure contact between front brushes 55 and the tunnel portion of reed 120. Drive cable 98 passes through reed guide 46 and end plate 7.

At the end of drive cable 98 is locking block 102 that is secured with ferrule 103. Locking block 102 is fastened, via securing means such as a screw, to the end of reed 120 opposite the point from which the apparatus will begin to clean. Drive motor 90 turns drive and meshing gears 91, 93, which in turn cause winder drum 97 to rotate. The rotation of winder drum 97 causes drive cable 98 to be taken up and the apparatus to be pulled across the width of reed 120.

FIG. 4 shows a schematic, cross-sectional view of the reed and auxiliary air nozzle cleaning apparatus, as seen along line 4—4 of FIG. 3. FIG. 4 shows the position of the apparatus in relation to reed 120 and auxiliary air nozzle 124 of an air jet weaving machine. Reed 120 is cleaned by front brushes 55 and rear brushes 85 that contact the front and rear surfaces of reed 120. Front brushes 55 are also in contact with auxiliary air nozzle 124. Auxiliary air nozzles 124 are spaced across the width of the loom, and, therefore, are subject to the cleaning effect of front brushes 55 as the apparatus moves across the loom.

Operation

The weaving machine should be stopped prior to the commencement of cleaning. The harnesses of the weaving machine are arranged, most preferably, in an all-down position, or, alternatively, in an all-level position, to create space for the cleaning apparatus.

Each weaving machine has a cycle of motions that are associated with one revolution of the weaving machine motor; cycles are designated by degree markings with a complete cycle consisting of 360 degrees. For efficient operation of the cleaning apparatus of the present invention, it is desirable to align reed 120 in the range of about 280° to 295° in relation to the operating cycle at the weaving machine. Most preferably, reed 120 should be aligned at about 290°.

The cleaning apparatus is rocked gently into position on one end of reed 120, and an air supply conduit (shown in phantom at 130 in FIG. 1) is attached to the cleaning apparatus. Air flows into the apparatus and through directional switch 26, which, when engaged, activates the clamping motion of clamping air cylinder 34 and secures the apparatus in position on reed 120. Reed guides 44, 46 are checked to assure that they are in contact with the top portion of reed 120.

Locking pin 96 is removed from the groove in locking plate 94, causing winder drum 97 to be released from its locked position. A length of drive cable 98 is pulled from winder drum 97. Locking block 102 is affixed to the opposite end of reed 120, creating a length of drive cable 98 that is taken up as the apparatus moves across reed 120. Winder drum 97 is then returned to the locked position by compressing spring 95 and inserting locking pin 96 into locking plate 94.

A cleaning solution is applied manually to reed 120. An alternative to applying the solution by hand is to incorporate into the apparatus one or more spray nozzles that automatically dispense such solution onto reed 120. Any conventional cleaning solution capable of loosening the accumulations in the reed and lubricating the yarns to prevent breakage is acceptable for use.

On/off lever 14 is turned to the "on" position, thereby initiating the flow of air into pneumatic motors 50, 80, 90. Drive motor 90 turns winder drum 97, winder drum 97 takes up the slack length of drive cable 98, and the apparatus is pulled across the width of reed 120. As the apparatus moves across the weaving machine, brush motors 50, 80 cause brushes 55, 85 to counter-rotate, and thereby clean reed 120 and, where applicable, auxiliary air nozzles 124.

When cleaning has been completed (i.e., the apparatus reaches the opposite end of reed 120), on/off lever 14 is turned to an "off" position, thus stopping air flow into pneumatic motors 50, 80, and 90. Directional switch 26 is returned to a disengaged position, thereby causing the clamping action of clamping air cylinder 34 and clamping roller mount 40 to be released. Locking block 102 is then detached from reed 120. A rocking motion is used to remove the apparatus from reed 120.

The fact that accumulations of dirt, size, lint, and the like have been brushed from the reed (and, in air jet weaving machines, from the auxiliary air nozzles) and deposited on the fabric is not problematic, because the fabric will be washed at a later point in the production process. With some fabric styles, it may be necessary to attach a nozzle to air supply conduit 130 and blow the dislodged debris away from reed 120 to prevent its reaccumulation in reed 120.

Once the cleaning has been completed and the apparatus removed, reed 120 and the harnesses of the weaving machine are returned to their running configuration. The loom is restarted and its operating efficiency is restored.

I claim:

1. An apparatus for cleaning a stopped weaving machine having a reed with warp yarns passing therethrough, said warp yarns forming a yarn sheet on said machine, wherein said weaving machine is an air jet weaving machine having a series of auxiliary air nozzles, said apparatus comprising a motive means for moving said apparatus along said reed, a cleaning means for removing debris from said reed, and a yarn-deflecting means for deflecting the warp yarn sheet and allowing said cleaning means to act on said reed as said apparatus moves along said reed, and wherein said cleaning means is adapted to simultaneously remove debris from both said reed and said series of auxiliary air nozzles as said apparatus moves along said reed.

2. The apparatus of claim 1 wherein said apparatus comprises an integrated clamping means for securing said apparatus in an operative position on said reed as said apparatus moves along said reed.

3. The apparatus of claim 2 wherein said clamping means is comprised of a clamping air cylinder and a clamping roller mount that is cooperatively positioned with respect to said clamping air cylinder.

4. The apparatus of claim 3 which further comprises a directional switch for actuating said clamping means by directing air into said clamping air cylinder.

5. The apparatus of claim 1 wherein said motive means is comprised of a pneumatic drive motor, a winder drum associated with said drive motor, and a length of drive cable having a first end attached to said winder drum and a second end attached to a locking block.

6. The apparatus of claim 5 wherein said motive means further comprises securing means associated with said locking block for securing said second end of said drive cable to said reed, thereby allowing said apparatus to be pulled along said reed as said length of drive cable is wound around said winder drum.

7. The apparatus of claim 1 wherein said yarn-deflecting means is comprised of a pair of yarn deflector bars extending along the length of said apparatus, each yarn deflector bar having a plurality of yarn deflector wheels attached thereto, said wheels being positioned to engage said warp yarns.

8. The apparatus of claim 1 wherein said cleaning means is comprised of a plurality of rotating brushes.

9. The apparatus of claim 8 wherein said cleaning means is comprised of at least one front rotating brush, attached to a front brush shaft and operably associated with a front brush motor, and at least one rear rotating brush, attached to a rear brush shaft and operably associated with a rear brush motor.

10. The apparatus of claim 9 wherein said front brush motor and said rear brush motor are pneumatic motors, and wherein said front brush shaft and said rear brush shaft counter-rotate in relation to one another.

11. The apparatus of claim 9 wherein said front brush motor and said rear brush motor turn said front brush shaft and said rear brush shaft, respectively, at a rotational speed in the range of 300 to 1100 revolutions per minute.

12. The apparatus of claim 9 wherein said apparatus has more than two brush shafts.

13. A method for cleaning a weaving machine having a reed, wherein a sheet of warp yarns passes through said reed, said method comprising the steps of mounting on said reed a self-propelled device having brush means, allowing said mounted device to move along said reed while said brush means is activated, and downwardly deflecting individual yarns comprising said yarn sheet making said reed accessible for cleaning as said device moves along said reed, thereby removing debris accumulations from said reed as said device moves along said reed.

14. The method of claim 13 wherein said weaving machine is an air jet weaving machine having a series of auxiliary air nozzles, and wherein said method comprises the additional step of simultaneously cleaning said reed and said series of auxiliary air nozzles with said activated brush means.

15. A method for cleaning debris from a stopped weaving machine having a reed and harnesses by using a pneumatically-actuated, self-propelled cleaning device, said method comprising the steps of:

(a) positioning said reed and harnesses of said weaving machine to provide for passage of said device between said reed and harnesses;

(b) positioning said device on one end of said reed;

(c) supplying pressurized air within a prescribed range to said device;

(d) clamping said device to said reed after said device is positioned on said reed;

(e) initiating a motive means for moving said device across said reed;

(f) applying cleaning solution to said reed;

(g) brushing debris accumulations from said reed by means of rotating brushes attached to said moving device;

(h) stopping said motive means when said device has traversed said reed; and (i) removing said device from said weaving machine.

16. The method of claim 15 that further includes the step of blowing said debris away from said reed after said device is removed from said weaving machine.

17. The method of claim 15 wherein said harnesses of said weaving machine are positioned in an all-down position.

18. The method of claim 15 wherein said harnesses of said weaving machine are positioned in an all-level position.

19. The method of claim 15 wherein the reed of said stopped weaving machine is positioned in the range of 280° to 295° in relation to the operating cycle of said weaving machine.

20. The method of claim 15 wherein said prescribed range of pressurized air being supplied by said main air supply conduit is in the range of 15 to 150 pounds per square inch (gauge).

* * * * *